US008734230B2

(12) United States Patent
Yoseloff

(10) Patent No.: US 8,734,230 B2
(45) Date of Patent: May 27, 2014

(54) PLAYER COMPING SYSTEM AND METHOD

(75) Inventor: Mark L. Yoseloff, Henderson, NV (US)

(73) Assignee: Well Suited, LLC, Henderson, NV (US)

( * ) Notice: Subject to any disclaimer, the term of this patent is extended or adjusted under 35 U.S.C. 154(b) by 750 days.

(21) Appl. No.: 13/010,972

(22) Filed: Jan. 21, 2011

(65) Prior Publication Data

US 2012/0190423 A1 Jul. 26, 2012

(51) Int. Cl.
*G07F 17/32* (2006.01)

(52) U.S. Cl.
USPC ..... 463/25; 463/13; 463/16; 463/20; 463/29

(58) Field of Classification Search
USPC ..... 463/13, 16, 20, 25; 273/292
See application file for complete search history.

(56) References Cited

U.S. PATENT DOCUMENTS

| | | | | |
|---|---|---|---|---|
| 6,244,958 | B1 | 6/2001 | Acres | |
| 6,343,989 | B1 * | 2/2002 | Wood et al. | 463/23 |
| 2004/0254005 | A1 | 12/2004 | Shackleford et al. | |

OTHER PUBLICATIONS

Wong, Stanford, "Professional Blackjack," Pi Yee Press, Las Vegas, Nevada, USA 2009, pp. 302-333.

* cited by examiner

*Primary Examiner* — Omkar Deodhar
(74) *Attorney, Agent, or Firm* — Mark A. Litman & Associates, P.A.

(57) ABSTRACT

A method is used in combination with a processor and symbol-reading or symbol-providing technology to provide incentives to casino players during playing time of the casino players at games in which quality of strategy of play or quality of wagering strategy is determined. This can be accomplished by:

a) identifying at least one specific player on a processor;

b) capturing game play information of that at least one player on the processor;

c) on hands or rounds where there are alternative playing or wagering strategies that can be played on specific hands, the processor identifying what play or wager strategy is executed by the at least one player;

d) the processor determining a valuation or valuation rate or valuation amount for the casino based upon specific play or wager strategy executed by the at least one player on the specific hands;

e) collecting valuation performance rates or amounts over an at least minimum number of played hands for the at least one player to determine at least one player valuator; and f) subsequent to the determination of the at least one player valuator, providing the at least one player with value based on the at least one player valuator for the at least one player.

27 Claims, 5 Drawing Sheets

PLAYER COMPING SYSTEM AND METHOD

BACKGROUND OF THE INVENTION

1. Field of the Invention

The present invention is directed to a method, device, and computer readable storage medium for tracking and marketing to select casino players. More particularly, the present invention relates to an improved methodology, system for tracking and marketing to select players.

2. Description of the Related Art

Casinos commonly use player tracking systems to track and market to players. Casinos issue a "players card" or "slot club card" to a player, who then uses this card when he plays casino games such as blackjack, craps, slot machines, video poker, etc. Computers are used to keep track of a player's bets. Based on the player's wagers (or "action"), the player may be given incentives (or "complimentaries" or "comps") by the casino, such as discounts on rooms or food, etc. The more casino action a player gives a casino, generally the greater his or her comps will be. If a player has wagered a small amount, he or she will typically not be given any or many comps, as the casino does not value this player's patronage. In this way, a casino encourages players that they value to return to their casino and gamble some more.

A drawback of the presently administered current comp systems is that casinos do not calculate a slot machine player's theoretical value to the casino in awarding comps; rather, they rely solely on the total amount wagered to make such awards. For example, the predominant current comp system does not consider a player's skill when the player plays electronic games such as video poker and video blackjack. Consider a first player who is unskilled at video poker and does not follow the proper strategy perfectly, and a second player who bets the same total amount but plays the hands perfectly. The current system would value these two players equally. However, of course the first player is more valuable to the casino, and with such knowledge the casino would provide such a player with more comps to encourage further play.

Published US Patent Application Document 20040254005 (Shackleford) discloses a method, apparatus, and computer readable storage which determines and tracks a player's error in a game of skill such as video poker. The player error is stored in a player's slot club account so that a beginning player may be entitled to additional complimentaries from the casino. The method includes (a) reading account information on a player's slot club card; (b) allowing the player to complete the hand; (c) calculating expected value points for the hand which incorporate a numerical computation of the player's error; and (d) accumulating the expected value points in the player's slot club account using information. This method appears to emphasize a real-time analysis, and even hand-to-hand analysis of strategy, with an immediate or even concurrent award of comps or comp rates based on player error. This is a highly ineffectual and complicated analytical method.

Therefore, what is needed is an improved comp system that takes into consideration a player's true theoretical, long-term value to the casino in determining the player's comps and the marketing efforts that should be used to attract specific players to casinos. All patents and references cited in this application are incorporated herein by reference in their entirety.

SUMMARY OF THE INVENTION

The present technology includes both apparatus, systems and a method of providing incentives to casino players based on play of the casino players at games in which quality of strategy of play or quality of strategy of wagering can be determined. The method executed by the apparatus or system may include:

a) identifying at least one specific player on a processor having symbol display capability thereon;
b) capturing game play information of that at least one player on player input to the processor;
c) on rounds of play where there are alternative play and/or wager strategies that can be played on specific hands, the processor identifying what specific play and/or wager strategy is executed by the at least one player;
d) the processor determining a valuation of performance to provide a player typecasting identifier such as a measurement, which may be expressed in any standard, constant, variable, rate, scholastic value, class, range of value or the like for the casino based upon the specific wagering and/or play strategies executed by the at least one player on the specific hands;
e) collecting valuation of performance data over an at least minimum number of played hands for the at least one player to determine a player valuator; and
f) subsequent to the determination of the player valuator, providing the at least one player with value. The value may be provided proportional to, inverse to, or scholastically based on determined player valuators for the at least one player.

The present technology includes both apparatus, systems and a method of providing incentives to casino players during playing time (e.g., without hand-by-hand changing of comp rates) or based on statistically significant long term play of the casino players at games in which quality of strategy of play or quality of strategy of wagering can be determined. The method executed by the apparatus or system may include:

a) identifying at least one specific player on a processor having symbol display capability thereon;
b) capturing game play information of that at least one player on player input to the processor;
c) on rounds of play where there are alternative play and/or wager strategies that can be played on specific hands, the processor identifying what specific play and/or wager strategy is executed by the at least one player;
d) the processor determining a valuation of performance for the casino based upon the specific wagering and/or play strategies executed by the at least one player on the specific hands;
e) collecting valuation of performance data over an at least minimum number of played hands for the at least one player to determine a player valuator; and
f) subsequent to the determination of the player valuator, providing the at least one player with value based upon player valuators for the at least one player.

It is another aspect of the present invention to provide improvements and innovations in casino player tracking, complimentary, and marketing systems. The present technology may include systems and methods that (a) read account information on a player's slot club card (or allow for casino personnel to input such data into a software/hardware system); (b) allows the player to complete all of the hands or rounds desired in the play of games during a session; (c) calculates deviation from optimal play for the individual hands or rounds during a session by a numerical computation of the player's error; and (d) accumulates such deviation from optimum play data in the player's slot club account, which may include using information stored on the slot club card. At least one important improvement over the art includes the time-based, or session-based cumulative assessment of deviation from optimal play (error rate) and the associated theoretical expected additional win (error value) to the casino. The use of such longer term analytical data trends to "value" players provides casinos with substantially better information than is currently available allowing them to provide certain individual players with more and better comps to entice them to play at their facilities, while limiting or normalizing at a lower standard rate comps provided to other better skilled players.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DETAILED DESCRIPTION OF THE PRESENT INVENTION

Figure 1:
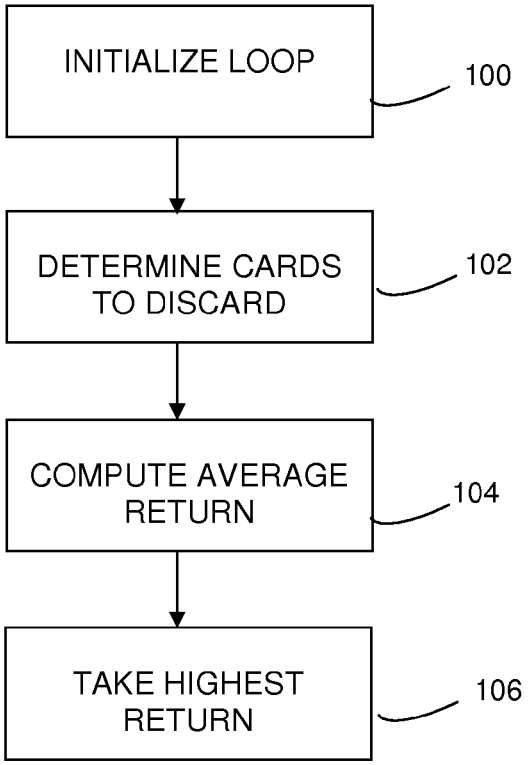
FIG. 1 is a flowchart illustrating a method of calculating the optimal value of a single dealt hand, according to an embodiment of the present invention, which calculated optimal value and player activity may be assessed and incorporated into an overall or long-term valuation of player skill.

Reference will now be made in detail to the presently preferred embodiments of the invention, examples of which are illustrated in the accompanying drawings, wherein like reference numerals refer to like elements throughout.

The present invention relates to improving player tracking, evaluation, and marketing systems. The invention relates to determining and using an individual player's skill level in order to present a more complete picture of a player's ability and the player's value to a casino.

Tracking a player's play can be accomplished either on table games or on machine games. A table game typically requires a casino employee to manually enter a player's plays. On a machine game, the machine can automatically track a player's plays upon identification of players (e.g., with casino cards, player cards, preferred player cards and the like), which identification is preferably transmitted from the local table or gaming apparatus such as a video or slot machine, to a central repository server or processor to store player and wagering information).

The present technology includes both apparatus, systems and a method of providing incentives to casino players based on play of the casino players at games in which quality of strategy of play or quality of strategy of wagering can be determined. The method executed by the apparatus or system may include:

a) identifying at least one specific player on a processor having symbol display capability thereon. By symbol display technology is meant physical reel display, physical playing cards (which can be read by sensors or cameras or reader), virtual playing card providers for display systems, virtual symbol providers for non-card games, and the like;

b) capturing game play information of that at least one player on player input to the processor, said player input based upon sensed, read, or input information (e.g., by card sensors or readers, electrical or electromechanical systems that read and/or analyze signals or sensed information, reading touchscreen and/or button inputs, alone or in combination with data originally or secondarily provided by a processor and/or field programmable gated arrays (FPGA) or application specific instruction-set processor (ASIP)), and the game may be played on electronic gaming tables (e.g., Shuffle Master i-Table™ gaming system, multi-player electronic gaming system formats, with or without dealer view screen, mixed electronic wagering and physical playing card systems and the like;

c) on rounds of play where there are alternative play and/or wager strategies that can be played on specific hands, the processor identifies what specific play and/or wager strategy is executed by the at least one player;

d) the processor determines a valuation of performance for the casino based upon the specific wagering and/or play strategies executed by the at least one player on the specific hands. Valuation of performance is described in greater detail herein;

e) the processor collects valuation of performance over an at least minimum number of played hands for the at least one player to determine player valuators. The "minimum number of played hands" should be statistically significant. Play of large numbers of hands over shorter periods of times (e.g., 600 hands in one hour) may be weighted higher in the valuation although collections of small numbers of hands over larger periods of time (e.g., 10 sets of 60 hands each over a 5 day period) may be weighted lower in the valuation or equally as the same number of hands may be used as statistically significant. As a guideline that does not limit the practice of the present technology, at least 100 hands, preferably at least 250 hands, more preferably at least 500 hands, and still more preferably at least 750, 1000, 1500 or 2500 hands in which wagering strategy or playing strategy are executed should be used in valuation procedures; and f) subsequent to the determination of the player valuators, providing the at least one player with value based on the player valuators for the at least one player. The value may be provided proportional to, inverse to, or scholastically based on determined player valuators for the at least one player. This provision of value may be comp rates, comp value, free spins, special bonus play, absolute value added to total comp value on a player card, discount at casino hotels, restaurants, shows, spas and other facilities, gifts, coupons for stores, cash, credit, and the like.

All slot machines and the games enabled thereby are designed to provide a theoretical long-term return to the casino operator based upon specific, calculable mathematics. Machines can be divided into two categories; namely, those in which the player makes both wagering and playing decisions such as video poker, video blackjack and video keno and those in which the player makes wagering decisions but no playing decisions such as spinning reel machines with one-time random symbol placements on pay lines. It is an aspect of the present invention to provide casinos with a more accurate theoretical value profile of each slot machine player than is presently available today. A player's theoretical value profile and theoretical value are calculated as an amount of money and is the amount that the casino is expected to win over the long run given the individual's playing parameters. This theoretical value for a player is based upon several factors as is more fully described below.

In broad terms a player's theoretical value (PTV) can be determined by the following basic formula:

$$PTV=(\text{amount wagered per spin})\times(\text{number of spins})\times(\text{house advantage per spin})$$

So, if a player is wagering one dollar per spin on a game with a theoretical house advantage of 8% per spin and plays 1000 times, that player's theoretical value to the casino is $1 times 1000 plays times 8% or $1×1000×0.08 which equals $80. Now, consider a second player who wagers two dollars per spin on a game with a theoretical house advantage of 4% and plays 500 times. This player's PTV is $2×500×0.04 which equals $40. Notice that both players wagered a total of $1,000 yet the second player is only worth half as much to the casino as the first player. Using current methods and technology both of these players would be awarded an equal number of slot club points and hence would be entitled to equal comps. It is an objective of the technology described herein to provide casinos with the PTV data which would allow them to differentiate these two players.

Looking now at slot machines in which playing decisions are involved, consider the case of video poker, a highly popular game in casinos. Five cards are dealt to the player, and the player chooses which of the five cards to keep and which to replace. The goal is for the player to create certain hands which pay according to an active pay table. A video poker machine typically displays a description of the paying hands and how much each hand pays as a multiple of the original bet.

Video poker comes in many variations, which include (but not limited to): Jacks or Better, Deuces Wild, Joker Poker, etc. Each variation has its own pay table and special rules. For example, in Joker Poker, a wild joker is added to a standard deck. In Deuces wild, all deuces (twos) are wild. Of course, the pay table is adjusted to reflect each game's particular rules.

Video poker should not be played according to "hunches" or what some players may consider common sense. There is a known mathematical strategy for playing the game to reduce (or even eliminate) the house edge as much as possible. For every variation of video poker and every specific pay table there is a calculable best strategy for playing each hand dealt. If a player applies this best strategy to every hand dealt the house advantage of the game will be minimized as much as possible. Any deviation from this optimal strategy will increase the theoretical value (PTV) of the player to the casino.

As an example consider Double Double Bonus Poker, a popular variant of the game. In this game certain four-of-a-kinds pay bonuses and the highest ranking hand is the royal flush (10, J, Q, K and Ace of the same suit) as is shown in Table I.

TABLE I

| | Coins Bet | | | | |
|---|---|---|---|---|---|
| Hand | 1 | 2 | 3 | 4 | 5 |
| Royal Flush | 250 | 500 | 750 | 1000 | 4000 |
| Straight Flush | 50 | 100 | 150 | 200 | 250 |
| 4-Aces w/2, 3, or 4 | 400 | 800 | 1200 | 1600 | 2000 |
| 4-Aces w/5 through K | 160 | 320 | 480 | 640 | 800 |
| 4-2's, 3's or 4's w/Ace | 160 | 320 | 480 | 640 | 800 |
| 4-2's, 3's or 4's no Ace | 80 | 160 | 240 | 320 | 400 |
| 4-5's through K's | 50 | 100 | 150 | 200 | 250 |
| Full House | 9 | 18 | 27 | 36 | 45 |
| Flush | 6 | 12 | 18 | 24 | 30 |
| Straight | 4 | 8 | 12 | 16 | 20 |
| Three of a Kind | 3 | 6 | 9 | 12 | 15 |
| Two Pair | 1 | 2 | 3 | 4 | 5 |
| Jacks or Better | 1 | 2 | 3 | 4 | 5 |

Now assume that a player is dealt the king, queen, jack and 4 of hearts and the queen of diamonds. There are three likely choices as to what to hold; namely, 1) the pair of queens, 2) the three face cards in hearts, 3) all four hearts. Off hand, to a novice player, the pair of queens might seem like the best choice since it is a guaranteed win. However, if a player is playing a one dollar machine and wagers $5, the expected return of each of these three choices is as follows: 1) $6.88, 2) $6.98, 3)$6.60. So, the optimal play is to hold the three cards to the Royal Flush. Hence, a player employing either of the other strategies will increase his PTV to the casino every time he makes these plays.

To demonstrate just how subtle this strategy issue is, consider a second version of the same game, Double Double Bonus Poker with the pay table shown in Table II.

TABLE II

| | Coins Bet | | | | |
|---|---|---|---|---|---|
| Hand | 1 | 2 | 3 | 4 | 5 |
| Royal Flush | 250 | 500 | 750 | 1000 | 4000 |
| Straight Flush | 50 | 100 | 150 | 200 | 250 |
| 4-Aces w/2, 3, or 4 | 400 | 800 | 1200 | 1600 | 2000 |
| 4-Aces w/5 through K | 160 | 320 | 480 | 640 | 800 |
| 4-2's, 3's or 4's w/Ace | 160 | 320 | 480 | 640 | 800 |
| 4-2's, 3's or 4's no Ace | 80 | 160 | 240 | 320 | 400 |
| 4-5's through K's | 50 | 100 | 150 | 200 | 250 |
| Full House | 9 | 18 | 27 | 36 | 45 |
| Flush | 5 | 10 | 15 | 20 | 25 |
| Straight | 4 | 8 | 12 | 16 | 20 |
| Three of a Kind | 3 | 6 | 9 | 12 | 15 |
| Two Pair | 1 | 2 | 3 | 4 | 5 |
| Jacks or Better | 1 | 2 | 3 | 4 | 5 |

This game is identical to the one shown in Table I except that the Flush pays 5 times the wager instead of 6 times the wager. Now assume that the player receives the same hand as in our first example, namely, king, queen, jack and 4 of hearts and the queen of diamonds. Assuming the same three possible holds as above, the expected return of each of these three choices is now as follows: 1) $6.88, 2) $6.82, 3) $5.64. So, this subtle change in the pay table now makes holding the pair of queens the optimal strategy. No present player tracking system is equipped to handle such variations.

An improved player tracking system would keep long term track of the player's additional value to the casino for each hand dealt. An unskilled player that makes more mistakes should be entitled and considered for special promotions and marketing efforts by the casinos. More on ways of computing this cost and ways to track it will be described below.

As an example of ways to play a hand, consider a player who is playing 9/6 Jacks or Better video poker and is dealt: 2 of hearts; 4 of spades; 8 of hearts; 9 of clubs, and queen of spades. The player can keep or discard each of the 5 cards, for 32 possible ways to play the hand. The pay table for this game is shown in Table III. A table can be created for each way to play the hand, and a breakdown of the number of paying (and losing) hands possible. Table IV and Table V, based on 9/6 Jacks or Better, represent such a table for the example hand given.

TABLE III

| | Coins Bet | | | | |
|---|---|---|---|---|---|
| Hand | 1 | 2 | 3 | 4 | 5 |
| Royal Flush | 250 | 500 | 750 | 1000 | 4000 |
| Straight Flush | 50 | 100 | 150 | 200 | 250 |
| Four of a Kind | 25 | 50 | 75 | 100 | 125 |
| Full House | 9 | 18 | 27 | 36 | 45 |
| Flush | 5 | 10 | 15 | 20 | 25 |
| Straight | 4 | 8 | 12 | 16 | 20 |
| Three of a Kind | 3 | 6 | 9 | 12 | 15 |
| Two Pair | 2 | 4 | 6 | 8 | 10 |
| Jacks or Better | 1 | 2 | 3 | 4 | 5 |

TABLE IV

| Kept cards | Nothing | High pair | Two pair | 3 of a kind | Straight |
|---|---|---|---|---|---|
| 2h, 4s, 8h, 9c, Qs | 1 | 0 | 0 | 0 | 0 |
| 2h, 4s, 8h, 9c | 47 | 0 | 0 | 0 | 0 |
| 2h, 4s, 8h, Qs | 44 | 3 | 0 | 0 | 0 |
| 2h, 4s, 8h | 1024 | 21 | 27 | 9 | 0 |
| 2h, 4s, 9c, Qs | 44 | 3 | 0 | 0 | 0 |
| 2h, 4s, 9c | 1024 | 21 | 27 | 9 | 0 |
| 2h, 4s, Qs | 913 | 132 | 27 | 9 | 0 |
| 2h, 4s | 14295 | 780 | 711 | 281 | 128 |
| 2h, 8h, 9c, Qs | 44 | 3 | 0 | 0 | 0 |
| 2h, 8h, 9c | 1024 | 21 | 27 | 9 | 0 |
| 2h, 8h, Qs | 913 | 132 | 27 | 9 | 0 |
| 2h, 8h | 14258 | 780 | 711 | 281 | 0 |
| 2h, 9c, Qs | 913 | 132 | 27 | 9 | 0 |
| 2h, 9c | 14423 | 780 | 711 | 281 | 0 |
| 2h, Qs | 12248 | 2955 | 711 | 281 | 0 |
| 2h | 148980 | 15357 | 8874 | 4102 | 382 |
| 4s, 8h, 9c, Qs | 44 | 3 | 0 | 0 | 0 |
| 4s, 8h, 9c | 1024 | 21 | 27 | 9 | 0 |
| 4s, 8h, Qs | 913 | 132 | 27 | 9 | 0 |
| 4s, 8h | 14359 | 780 | 711 | 281 | 64 |
| 4s, 9c, Qs | 913 | 132 | 27 | 9 | 0 |
| 4s, 9c | 14423 | 780 | 711 | 281 | 0 |
| 4s, Qs | 12083 | 2955 | 711 | 281 | 0 |
| 4s | 148534 | 15357 | 8874 | 4102 | 828 |
| 8h, 9c, Qs | 897 | 132 | 27 | 9 | 16 |
| 8h, 9c | 14183 | 780 | 711 | 281 | 240 |
| 8h, Qs | 12200 | 2955 | 711 | 281 | 48 |
| 8h | 148455 | 15357 | 8874 | 4102 | 907 |
| 9c, Qs | 12136 | 2955 | 711 | 281 | 112 |
| 9c | 148290 | 15357 | 8874 | 4102 | 907 |
| Qs | 118674 | 45456 | 8874 | 4102 | 589 |
| None | 1205537 | 213648 | 71802 | 31502 | 5979 |

TABLE V

| Kept cards | Flush | Full house | 4 of a kind | Str flush | Royal flush | Exp Value |
|---|---|---|---|---|---|---|
| 2h, 4s, 8h, 9c, Qs | 0 | 0 | 0 | 0 | 0 | 0.00000 |
| 2h, 4s, 8h, 9c | 0 | 0 | 0 | 0 | 0 | 0.00000 |
| 2h, 4s, 8h, Qs | 0 | 0 | 0 | 0 | 0 | 0.06383 |
| 2h, 4s, 8h | 0 | 0 | 0 | 0 | 0 | 0.09436 |
| 2h, 4s, 9c, Qs | 0 | 0 | 0 | 0 | 0 | 0.06383 |

TABLE V-continued

| Kept cards | Flush | Full house | 4 of a kind | Str flush | Royal flush | Exp Value |
|---|---|---|---|---|---|---|
| 2h, 4s, 9c | 0 | 0 | 0 | 0 | 0 | 0.09436 |
| 2h, 4s, Qs | 0 | 0 | 0 | 0 | 0 | 0.19704 |
| 2h, 4s | 0 | 18 | 2 | 0 | 0 | 0.23244 |
| 2h, 8h, 9c, Qs | 0 | 0 | 0 | 0 | 0 | 0.06383 |
| 2h, 8h, 9c | 0 | 0 | 0 | 0 | 0 | 0.09436 |
| 2h, 8h, Qs | 0 | 0 | 0 | 0 | 0 | 0.19704 |
| 2h, 8h | 165 | 18 | 2 | 0 | 0 | 0.26192 |
| 2h, 9c, Qs | 0 | 0 | 0 | 0 | 0 | 0.19704 |
| 2h, 9c | 0 | 18 | 2 | 0 | 0 | 0.20086 |
| 2h, Qs | 0 | 18 | 2 | 0 | 0 | 0.33500 |
| 2h | 328 | 288 | 52 | 2 | 0 | 0.29658 |
| 4s, 8h, 9c, Qs | 0 | 0 | 0 | 0 | 0 | 0.06383 |
| 4s, 8h, 9c | 0 | 0 | 0 | 0 | 0 | 0.09436 |
| 4s, 8h, Qs | 0 | 0 | 0 | 0 | 0 | 0.19704 |
| 4s, 8h | 0 | 18 | 2 | 0 | 0 | 0.21665 |
| 4s, 9c, Qs | 0 | 0 | 0 | 0 | 0 | 0.19704 |
| 4s, 9c | 0 | 18 | 2 | 0 | 0 | 0.20086 |
| 4s, Qs | 165 | 18 | 2 | 0 | 0 | 0.39605 |
| 4s | 326 | 288 | 52 | 4 | 0 | 0.30707 |
| 8h, 9c, Qs | 0 | 0 | 0 | 0 | 0 | 0.25624 |
| 8h, 9c | 0 | 18 | 2 | 0 | 0 | 0.26007 |
| 8h, Qs | 0 | 18 | 2 | 0 | 0 | 0.34684 |
| 8h | 325 | 288 | 52 | 5 | 0 | 0.30909 |
| 9c, Qs | 0 | 18 | 2 | 0 | 0 | 0.36263 |
| 9c | 490 | 288 | 52 | 5 | 0 | 0.31464 |
| Qs | 327 | 288 | 52 | 2 | 1 | 0.47442 |
| None | 2982 | 2124 | 344 | 18 | 3 | 0.34198 |

For example, given that the play keeps all of his cards, row 1 indicates that this results in only 1 way to make a non-paying hand ("nothing"). This has an expected value of 0. If the 2, 4, 8 and queen are kept, row 3 indicates that there are 44 ways to make a non-paying hand, and 3 ways to make a high pair (i.e. 3 other queens to match the kept queen). The expected value here is 0.06, that is, for every $1 bet, the player can expect on average to return 6% or 6 cents. From typically available tables, it is clear that the best play is to keep only the queen, as it is the play with the highest expected value. The specific optimal strategies have been well discussed and published in many forms of literature and on-line and are well understood by the ordinarily skilled video game player and manufacturer.

FIG. 1 is a flowchart illustrating a method of calculating the optimal value of a dealt hand, according to an embodiment of the present invention. Calculating the optimal value of a dealt hand is important so that the system knows how much the hand is worth if no error has been made. FIG. 1 illustrates the "cycling" method calculating the optimal value by cycling through all 32 ways to compute values. The method starts with operation 100, which initializes a loop through the 32 different combinations of cards that can be kept/discarded. There are five cards dealt, and each card can be kept or discarded, for $2^5$=32 different possibilities. Thus, the method does a computation for all 32 possibilities.

From operation 100, the method then proceeds to operation 102, which determines which cards to discard. This can be done by giving a binary equivalent of the loop value (from 1 to 32) can be computed and assigned to the cards 1-5, and cards with a '1' value are kept while cards with a '0' value are discarded. In another embodiment, five separate loops from 1 to 2 can be used (instead of one loop from 1 to 32) which represent the status of each card.

Once the discarded cards are determined, the method then proceeds to operation 104, which computes the average return for each of the 32 ways to play the hand. This can be done by cycling through nested loops for each of the discarded cards so that every possible card combination is cycled through. For example, if only one card is discarded, then that card is cycled through the 47 cards which were not dealt on the initial deal. If two cards are discarded, then the first discarded card is cycled through the 47 cards which were not dealt on the initial deal, and the second discarded card is cycled through 46 cards (5 cards were already dealt on the initial deal, and 1 card was dealt to the first discarded card). Alternatively, to save computing time, redundant combinations do not have to be cycled through. For example, instead of running through 47*46=2162 combinations, this can be reduced in half since the order of the cards does not matter. One way of accomplishing this is to number the cards left in the deck from 0 to 46. For the first card, cards numbered 0 through 45 are cycled through. For the second card, (1+first card index) to 47 are cycled through. This only requires (47*46)/2=1081 combinations. In this way, every possible card combination is produced. The return (according to a selected pay table) is stored for each of the combinations and averaged for each of the 32 possible ways to hold/discard cards.

Figure 2:
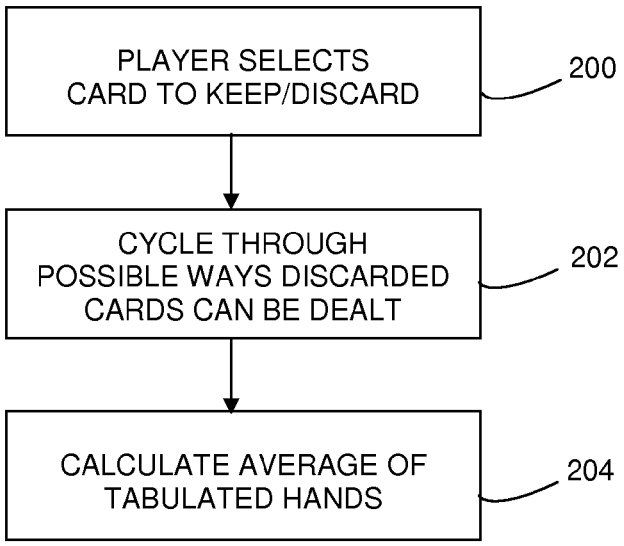
FIG. 2 is a block diagram illustrating the components used to implement an improved player tracking system, according to one embodiment of the present invention.

From operation 104, the method then proceeds to operation 106, which takes the highest return of the 32 combinations. This represents the value for the optimal play given the 5 cards initially dealt. The method illustrated in FIG. 2 illustrates how to calculate the optimal value of a dealt hand. However, an unskilled player may not always choose to play his hand in the optimal way.

FIG. 2 is a flowchart illustrating a method of calculating the expected value of a played hand, according to an embodiment of the present invention. The expected value of the played hand is calculated so that it can be subtracted from the optimal value of the hand to determine the player error. The method starts with operation 200, in which the player selects the cards the player wishes to keep/discard. This can be using any standard input device, such as a touch screen, buttons, keyboard, mouse, etc. From operation 200, the method proceeds to operation 202 which cycles through all the possible ways the discarded cards can be dealt. This is similar to operation 104 from FIG. 1. The returns for each of the hands are computed and tabulated using a selected pay table for the game. From operation 202, the method proceeds to operation 204, which calculates the average of the tabulated hands is computed, which represents the return for the way the hand was played.

Figure 3:
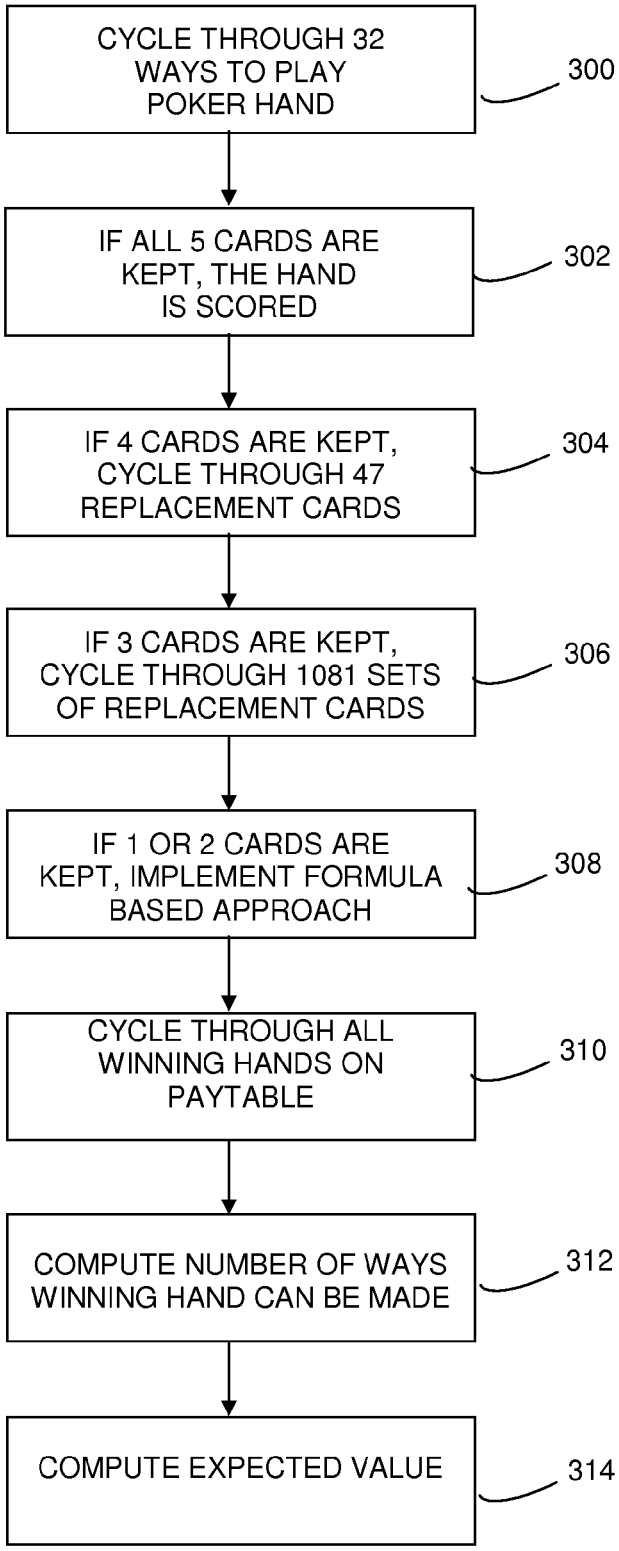
FIG. 3 is a flowchart illustrating an alternative method of calculating the optimal value of a dealt hand, according to an embodiment of the present invention.
Figure 3A:
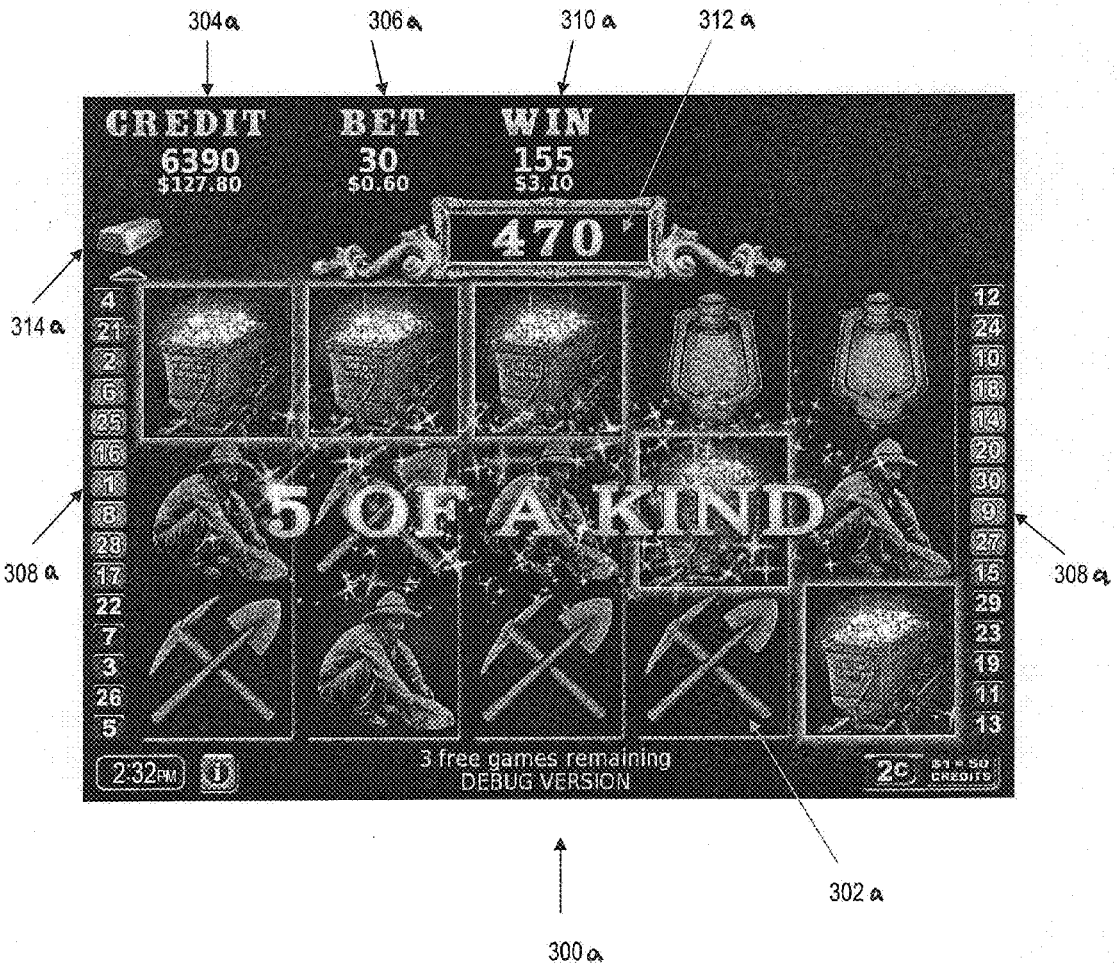

FIG. 3 is a flowchart illustrating an alternative method of calculating the optimal value of a dealt hand, according to an embodiment of the present invention. This alternative method uses a "formula based" approach and is faster than the method illustrated in FIG. 1. The method starts with operation 300, which cycles through all 32 ways to play a video poker hand. See the description above for more details.

From operation 300, the method proceeds to operation 302, wherein if all five cards are kept, the hand is simply scored. Then the method proceeds back to operation 300, which cycles through the next combination (unless all 32 ways have been cycled through). From operation 302 (assuming all five cards were not kept), the method proceeds to operation 304, wherein if 4 cards are kept, then the 47 possible replacement cards are cycled through which are scored and averaged. Then the method proceeds back to operation 300, which cycles through the next combination (unless all 32 ways have been cycled through). From operation 304 (assuming four cards were not kept), the method proceeds to operation 306, wherein if 3 cards are kept, then the 1081 ((47*46)/2) possible sets of two replacement cards are cycled through which are scored and averaged. Then the method proceeds back to operation 300, which cycles through the next combination (unless all 32 ways have been cycled through). From operation 306 (assuming three cards were not kept), the method proceeds to operation 308, wherein a formula based approach is used to calculate the return. At this point, the number of cards to cycle through becomes costly in terms of computing time, so the following formula based approach results in a faster computation time. Operation 308 implements a formula based approach to calculate the expected return when the number of cards to deal gets prohibitively high (typically 4 or 5 cards). This approach calculates the number of each type of winning hand possible based on the current cards the player holds, and then calculates the overall expected value. The formula based approach comprises operation 310, which cycles through all the winning hands on the respective pay table. From operation 310, the method then proceeds to operation 312, wherein for each winning hand cycled through in operation 310, computes the number of different ways that winning hand can be made. The program contains a routine for each category of cards that can be kept (i.e. a pair, two consecutive cards, etc.) Each routine then tabulates every possible way the winning hand can be made given the kept cards. Given one or two cards, it is easy to write down all of the different ways a winning hand can be made. This is essentially what the routine does. From operation 310 (after all winning hands have been cycled through), the method then proceeds to operation 314, which computes the particular expected value. This is computed by computing the product of the number of different ways each winning hand can be made by what that winning hand pays according to the respective pay table. This product is then divided by the number of winning hands to get the expected value. The particular expected value will be computed for each of the 32 ways to play each hand, and stored.

From operation 300 (after all 32 ways to play the hand have been cycled through), the method then proceeds to operation 316, which determines the best particular expected value. This is determined by taking the highest expected value of the 32 values stored from operation 310. A matrix of 32 decimal numbers should be kept, one for each way to play the hand. All expected values should be in terms of one betting unit, based on the number of coins bet. The maximum expected value will be the greatest of these 32 numbers. It is noted that any combination of the cycling or formula based approaches can be used. For example, all possible replacement cards can be cycled through; or the formula based approach can be used to all situations; or a mixture of the two approaches can be used (i.e. for 1-2 discards, the cards can be cycled through. For more 3-5 discards, the formula based approach is used). The preferred method is to use the cycling approach for 1-2 cards and the formula based approach for all hands added together.

With the above methods, at least three useful statistics can be developed. The first is the Player's Total Error (PTE). For each hand played, the player's error (PE) is simply the difference between the expected value of the hand if played optimally versus the expected value based on the actual play made by the player multiplied by the bet size. Going back to our first example using Double Double Bonus Poker as exemplified by Table I, the player choosing to hold three to the royal flush has a player error of 0 since this is the optimal play. The player holding the pair of queens has a player error of \$6.98-\$6.88 or \$0.10 for a \$5 wager and the player choosing to hold all four hearts has a player error of \$6.98-\$6.60 or \$0.38 for a \$5 wager. The PTE is simply the total of all of the player's errors combined.

The other two useful statistics are the player's Theoretical Value (PTV) (which may be absolute values or rates based on units of time or amount of play) and the Player's Expected Return (PER). To understand this, consider how the casino's minimum expected return is calculated for a video poker game. In a non-joker video poker game there are 2,598,960 possible starting hands. If, for each hand, the optimal strategy is determined and the expected casino win or loss for this strategy is determined then by taking the average of all of these expected casino wins or losses the minimum expected return for the casino (which is a percentage of the amount wagered) can be calculated. If a player played perfectly then the Player's Expected Return (PER) to the casino would equal the minimum expected return and by multiplying this expected return by the number of hands played and the amount wagered per hand this would be his or her PTV. It is to be noted that a Player's Theoretical Value, Player's Expected Return an Player's Total Error need not be expressed in any particular value, but equivalent terms rating value of players in different units of measurement may be used in the practice of the present technology. For example, the valuation terms may be in time value (e.g., dollars lost by error/hour, percentage of wagers lost by error/hour, and dollars won by casino by player's error/hour). These are more rate oriented valuation terms. The specific measurement used is not significant as long as it expresses some term that quantifies actual value to the casino based on statistically significant data from actual wagering play by a specific player.

If one knew how a player was going to play each starting hand, then by applying the same methodology as above to the player's actual play, the player's PER could be determined by calculating the expected win or loss for each starting hand based on the player's actual hold choices and then averaging these for all 2,598,960 starting hands. Knowing how a player chooses to play any one hand provides little useful PER information. However, by accumulating the player's actual plays and expected values for play over a sufficient number of hands a progressively more accurate value can be determined for the player's PER. The casino may set an appropriate standard for minimum numbers of plays to enable an accurate evaluation of a player. Over time, as more information is available and analyzed, the error rate and value is adjusted to be more timely and accurate. Any changes in such data should not be based on real-time adjustments from hand to hand, but should be based on more significant numbers and times of play. Any changes in such data although in a less preferred embodiment may be adjusted on a real-time basis from hand to hand, still are meaningful only when based on more significant numbers of play and times of play. It is preferred that error rates be provided for an entire session (e.g., the time period during which a player's identification has been made and a minimum rate of play is maintained).

Finally, some shortcuts may be available when computing a player's PER. Going back to our Double Double Bonus example, although the specific cards were the king, queen, jack and 4 of hearts and the queen of diamonds, the four card holding could in fact have been any one suit and the other queen any other suit. Based on this, this one hand actually represents 12 identical, possible starting hands. Furthermore, the four of hearts could just as easily have been the 2, 3, 5, 6, 7, or 8 of hearts with precisely the same statistical outcomes. So, the one example hand actually represents seven possible starting hands involving four hearts and a diamond times the 12 possible suit combinations or 84 starting hands. Hence, by knowing how the player played this one hand, expected values can be assumed for the other 83 similar hands.

The choice a player makes regarding the variation of video poker as well as the pay table offered also affects the player's return and should ideally also be considered by the casino. For example, for the variation of video poker known as Deuces Wild, a pay table known as "full pay" optimally returns 100.77%. This means that someone who knows the optimal strategy for this pay table of Deuces Wild can make 0.77% on every bet, on average. On the other hand, an alternative payable of "Deuces Wild," returns only 98.91% if the player uses optimal strategy.

A casino would prefer that a player play a version of poker with lower payouts for equivalent hands and other lower player payback games such as "Joker Poker" and Deuces Wild poker which also have their own sets of pay tables and returns. The casino would prefer that a player play a version of Joker Poker that pays 94.1% over either of the Deuces Wild versions with a 95.8% payout or the traditional Video Poker that has as much as 98% player payback. The player's choice of machine can also be considered a part of the player's "error," as it is in his interest to choose the machine with the highest return percentage.

One of the major benefits of the present invention is that the method of capturing the player's PER already incorporates this game-related data. A player who is playing a game with an inherently lower optimal expected return for the casino will have a lower PER and hence will be identifiable as a less desirable customer.

The TPE and the player's PER and PTV can be stored and updated in the player's loyalty account (or slot club account). Generally, "loyalty account" and "slot club account" represent the same concept and can typically be used interchangeably. In this way, the casinos can specially market incentives, promotions, and other offers to the unskilled players which can compensate them for their mistakes. The greater the player's PTE, PER and PTV the more valuable the player is to the casino.

Unlike prior art efforts, these values can be directly used as input to gaming apparatus so that players receive individual comp value treatment and are informed that they will be provided with such special treatment at the beginning of sessions, rather than getting random "special" treatment within the software that is little appreciated by a player.

For example, during video gaming play, players are comped at specific rates. That is, when wagering $1.00 in play, a standard automatic comp is identified to the player, such as for example 1 point or $0.01 value of comp. Many casinos offer 2× comp or 3× comp or 5× comp (e.g., $0.02, $0.03 and $0.05 comp, respectively, which are retained on their accounts with the casinos) as a general enticement to all players. This can be disadvantageous to casinos as they are offering increased value to all players equally, and where the perfect player can actually accrue comps at a rate that would more than balance out losses. This would be a net loss to the casino because they are not differentiating among players on a long term basis. For example, a casino would make a profit by offering 10× comps to a player that plays video poker so inefficiently that he/she exhibits a 75% return on wagers, yet the casino would lose money to a player at 2× comp rates when that player plays at optimal strategies and exhibits a 99% return on wagers. The present technology would allow the casinos to more clearly differentiate among players and offer higher comp rates to players that are more likely to lose. Those players, even though losing, would be more attracted to the casino because of their rapidly building comp accounts.

Note that both the TPE and the Player's Theoretical Value are monetary amounts, while the player's PER is a percentage; however, a player tracking system can alternatively assign fixed (or discrete) numerical values to these values. For example, a system of rating players from one to five can be devised. So, for Total Player Error (TPE), if this value is 0 to $19.99 per $1,000 played the player is a 1. If the TPE is between $20 and $39.99 per $1,000 played the player is a 2 and so on. For PER and PTV, obviously a similar rating system can be devised. Of course, since this method has reduced accuracy, it is not the preferred method.

Note that if a player chooses not to play the full number of coins, on some pay tables he will suffer a loss of expected return. For example, by playing 5 coins, the return on a royal flush may be disproportionate to the return by playing 1-4 coins. Therefore, it is of course to the player's advantage in this case to play all 5 coins. One of the benefits of the present invention is that this information is automatically factored into the player's PER. It is noted that the optimal strategy could be different depending on the number of coins played, because if less than full coins are played the player will not seek royal flushes as aggressively. The mathematical methods of the current invention do, of course, take this into account.

Further, casinos may wish to track or compute just the (optimal value of the dealt hand-expected value of played hand) or (1−this value) as a measure of the player's skill level (typically skill level is independent of amount bet).

The technology described herein also is applicable to reel-spinning type slot machines due to the fact that the expected return to the player is often a variable based on the number of coins wagered. For example, consider what are known as buy-a-pay slot machines. These machines are those in which each additional coin wagered buys additional winning outcomes. An example of this is Blazing Sevens™ slot game. This is a three-coin, three-reel buy-a-pay with the following characteristics: There are bars, red sevens, Blazing sevens and blanks on each reel. The first coin wagered pays on any combination of bars, either solid (all of one type) or mixed as well as three blanks. The second coin wagered adds three red sevens and mixed sevens as winning combinations (note: these will pay nothing with one coin bet). Finally, the third coin adds the jackpot outcome which is three blazing sevens. Generally, with buy-a-pay games, each additional coin wagered reduces the house advantage or, alternately, increases the theoretical return to the player. So, consider a $1 Blazing Seven™ slot machine and assume the house advantage with one coin bet is 12%, with two coins bet it is 9% and with all three coins bet it is 6%. Now consider three different players:

Player 1 wagers one coin per spin and plays 900 times. Player 1's PER is 12% and PTV is $1×900×12%, or $108. Also, since a 6% wager is available on the game, the player's error based on this wager is $1 times the expected return difference of 12%-6%, or $0.06. Based on 900 plays, the PTE is $54.

Player 2 wagers two coins per spin and plays 450 times. Player 2's PER is 9% and PTV is $2×450×9%, or $81 and PTE is $27.

Player 3 wagers three coins per spin and plays 300 times. Player 3's PER is 6% and PTV is $3×300×6%, or $54 and PTE is $0.

All three players have wagered a total of $900 and all three will receive an identical 900 comp points using today's technology. However, Player 1 is worth twice as much as Player 3 to the casino which is demonstrated by Player 1's PER and PTV being double those of Player 3.

This concept extends beyond just buy-a-pays. Consider the example of two players, player A and player B. Player A is playing a two-coin $5 reel spinning slot with a theoretical 3% house advantage while player B is playing a 250-coin penny reel spinning slot with a theoretical 12% house advantage. Assuming eight spins per minute or 480 spins per hour, player A has PER of 3% and a PTV of $10×480×3% or $144 per hour to the casino. Player B has a PER of 12% and a PTV of $2.50×480×12% or $144 per hour as well. In one hour player A turns over $4,800 while player B turns over $1200 even though both are expected to lose the same $144 and hence have the same PTV. Give the current technology, player A would receive four times the comp value of player B. However, notice that Player B has a PER which is 4 times greater than Player A. It is an aspect of the technology described herein to capture this valuable data for the casino.

Progressive reel slots are often hybrids of a multiplier slot (each additional coin wagered simply multiplies the wins) and a buy-a-pay. As an example, consider Megabucks™ slot game. This is a three coin game in which the first two coins are simple multipliers; that is, all outcomes are paid with one or two coins in, with two coins winning double the pays for one coin. However, the third coin buys the progressive Megabucks™ slot game jackpot. So, a player wagering two coins and lining up the Megabucks™ slot game symbols wins $10,000 on a $1 Megabucks™ slot machine while a play wagering all three coins wins the multi-million dollar jackpot for the same outcome.

This aspect of the technology described herein can be described as a method of providing incentives to casino players based upon value of play for games in which quality of wagering strategy can be determined comprising:

a) identifying at least one specific player on a processor;
b) capturing game play information of that at least one player on the processor;
c) on hands where there are alternative wagering strategies that can be played on specific hands, the processor identifying what wagering strategy is executed by the at least one player;
d) the processor determining a valuation of performance for the casino based upon specific wagering strategy executed by the at least one player on the specific hands;
e) collecting performance data over an at least minimum number of played hands for the at least one player to determine at least one player valuator; and
f) subsequent to the determination of the at least one player valuator, providing the at least one player comps with value based on the at least one player valuator for the at least one player. The value may be provided proportional to, inverse to, or scholastically based on determined player valuators for the at least one player.

This aspect of the technology described herein can be alternatively described as a method of providing incentives (e.g., in the form of returned or original value) to casino players based upon value of play for games in which quality of wagering strategy can be determined comprising:

a) identifying at least one specific player on a processor;
b) capturing game play information of that at least one player on the processor;
c) on hands where there are alternative wagering strategies that can be played on specific hands, the processor identifying what wagering strategy is executed by the at least one player;
d) the processor determining a valuation of performance for the casino based upon specific wagering strategy executed by the at least one player on the specific hands;
e) collecting performance data over an at least minimum number of played hands for the at least one player to determine at least one player valuator; and
f) subsequent to the determination of the player valuator, providing the at least one player comps with value based on the at least one player valuator for the at least one player. The value may be provided proportional to, inverse to, or scholastically based on determined player valuators for the at least one player.

There are numerous potential uses for the data made available by the present invention. A player's expected win/loss can also be estimated for a future session. For example, assuming a casino is reviewing a player's record and wishes to decide whether to offer him comps or special incentives to return. The player's future losses per day, which is the player's PTV per day, may be calculated as follows by estimating the average hands per day and average wager per hand from historic data regarding the player:

$$\text{PTV/day}=(\text{average hands per day})\times(\text{average wager per hand})\times\text{PER}$$

Furthermore, the casino can simply review the player's prior PTV which data is also available using the technology of the present invention.

The present invention can optionally take into consideration comps already given based on the standard comp system. As discussed above, the standard comp system returns an amount to each player based on their wagers, but not their skill level. The comp system described herein can work alongside the current standard comp system. If a player is comped a certain amount using the standard comp system, a casino may wish to disburse a dollar amount in additional comps based on a Player's Total Error (PTE). Recall that the PTE is the total dollar amount accumulated for the player as a result less than optimal play. As an example, a casino may elect to return 20% of a player's PTE in the form of free play. A player who utilizes perfect optimal strategy will have a PTE of zero and will receive no free play, while a player who has accumulated $1,000 in PTE will receive $200 in free play. This is far superior to today's method which awards free play solely based on prior coin in.

The information stored regarding the PTE, PER and PTV (and any other information discussed herein) can be used in numerous ways to market to desirable players. These players can receive and appreciate special offers which the experienced player may not receive. Such targeted marketing should ideally also increase house profits as well.

Such offers, marketing, or incentives can comprise offering free or discounted rooms or food, offering cash back upon return to the casino, sending targeted, advertisements for the casino, offering discounts on gift shop items or shows, gift certificates that can be used for any of the above, or any other standard way a casino may attempt to attract players. A casino may also send a check back to a player based on his PTE or PTV.

Another way of providing an incentive would be to issue a check cashable only at the casino or specified group of casinos (so the player must visit) or credit a player's slot club account electronically with "playable money." U.S. Pat. No. 6,244,958 teaches how a player's slot club account can actually store playable money to be used for wagering (note that this is different than comp points). A casino that wishes to market to a desirable play based on criteria discussed herein can credit a player's account with an amount of money based on a percentage of his or her PTE or PTV, or alternately, based on some dollar amount multiplied by his or her PER.

A casino may offer a credit to players for any of the above based on these parameters. For example, if a player's PTE in the player's loyalty account indicate that a player lost $100 due to player error, the casino may offer the player complimentaries based on this amount.

Casinos can issue an award amount based on either standard comp points, or comp points derived from any or all of the player's parameters (including his or her PTE, PTV or PER) or a combination of the two types of points (or concepts). The awarded amount can be computed by converting the respective comp amount (standard comps, PTE, PTV, PER) to a dollar amount. An award, once calculated, can also be adjusted to be a fixed selected amount (i.e. $25, $50, $75, $100, or any number), by checking a range for the fixed amounts and awarding the fixed amount that corresponds to the respective range the award amount falls between. This may be done so a player would not get an award (such as a check) for an odd amount, such as $23.28, in which the player may wonder how the amount was determined. For example, if a player's PTE is $487 and the award is based on 20% of PTE, the player would receive an award of $97.40. The casino may further wish to subtract $5 from this award, resulting in $92.40. Lastly, the casino can optionally round this to an even $25-multiple amount of $75 (by rounding down) or $100 (by rounding up). Again, casinos are free to choose parameters to suit their marketing preferences.

For example, in an embodiment of the present invention, if a player has earned what amounts to $20 in standard comp points and $50 in Parametric Comps (comps based on PTE, PTV and/or PER), the casino may wish to award the player $20+$50=$70 in general comps. Alternatively, the casino may wish to typically restrict certain awards to certain type of comps. For example, the casino may wish to issue checks to be cashed at the casino only based on parametric comps. Thus, in this case, the casino would award this player $20 in general comps but send a $50 check to the player. Similarly, a casino may wish to issue discounts on hotel rooms based on parametric comps, but apply standard comp points to food and beverage. Casinos are free to mix, match, configure, and use these systems in any manner they wish to suit their preferences. Further, any measure of comp points (i.e. standard comp points, parametric comps, and aggregated points (either aggregated immediately or later on) can be used in any manner described herein.

Once comp points are used they are typically subtracted from the player's account. Any kind of comp points may also expire after a predetermined amount of time, at the casinos option.

Sometimes a manual review of a player's player (or loyalty) account is performed. This may occur when a player calls a casino to ask for complimentaries. In this case, a special display can be produced for a player which includes parametric as well as standard comp information as described above.

Casinos can also maintain a separate list of preferred players based on their characteristics. For example, such a list may contain players with any or all of their Parametric Values (PTE, PTV, PER) over a predetermined amount, or any other combination of criteria. The list may be shared with other casinos.

Of course, a display according to the present invention may include any combination of the above information or additional information (whether described herein or elsewhere) as needed.

It is also noted that the parametric values, parametric comps and related information would typically not be automatically presented to the player, as this information is typically used for casino marketing purposes. The player can check his/her total standard points by inserting his/her card into most slot machines, which indicate total standard points in a small display by the card reader. On the other hand, a casino employee may mention the parametric values and comps at their discretion, for example if questioned by a casino patron about why their comps were at the level they were at.

In an additional embodiment, parametric comps may expire after a certain time. For example, if a certain amount of time goes by, parametric comps are no longer able to be utilized by the player.

Also, the present invention can identify "advantage" players, either automatically or by a casino employee upon reviewing a player's record. An advantage player can be defined as a player who plays at an expected return high enough that the casino does not care for his business, and may take such action as eliminating cash back points, prohibiting play of games vulnerable to a player advantage, or barring from casino property. As stated above, some variations/pay tables of video poker may have a high expected return. If a casino offers a full pay deuces wild game, and also offers a player 0.5% cash back on all bets, a player that plays optimal strategy will have an expected return of 101.27 (including cash back). A player that bets large denominations and plays very quickly can theoretically beat the house for a sizable amount of money in the long run. The present invention can identify advantage players by their skill level (as discussed above). Once identified, a casino may choose to reduce or not issue comps at all to such players, or even bar them. One way an expert player can be identified as follows:

expected total return>a predetermined expert return, and the total number of hands>a predetermined sample of hands Wherein the expected total return is the expected amount that the player should have received from his wagers, which can also take into consideration cash back by the casino. Note that this is not the actual amount, as the method is not concerned with the player's actual losses. A preferred formula for expected total return for use in this case is:

expected total return=optimal strategy return+(total cash back/total amount bet)−(expected value loss/total amount bet)

The above formula results in a value of 100% when the player is playing even with the house, and over 100% when the player is playing at an advantage. Note that if the player plays different versions of a game with different optimal strategy house edges, then a weighted average can be used for the optimal strategy house edge.

A preferred predetermined expert return is 100%, although other returns can be used as well, for example the casino may allow a player to return 100.1% before labeling him an advantage player.

The predetermined sample of hands is used so that a player isn't labeled an advantage player if he plays a number of hands which isn't a large enough sample of his play. A preferred predetermined sample of hands is 1000, although of course the casino can set this amount as to their preferences.

An alternative formula to that can be used to identify an advantage player is:

PER<a predetermined expert threshold and the total number of hands>a predetermined sample of hands Wherein the predetermined expert threshold is set by the casino but can preferably be zero (equivalent to 100 in the previous methodology). Note that preferably the formula may incorporate cash back with PER.

Further, the invention is not limited to video poker. The same methods/embodiments described herein can also be used for blackjack as well, either electronic or table based. Of course, if the blackjack game is table based, an input mechanism must be used to enter the cards dealt and the player's play. Cards may be scanned electronically by a video camera and inputted into the system electronically and automatically.

For blackjack, a table of the optimal value of a dealt hand and an expected value of a dealt/played hand can be found on the Internet or in blackjack literature such as Professional Blackjack, Fourth Edition, by Stanford Wong, pages 302-333. These values can simply be substituted in the formulas above to implement the present invention. Hence the figures herein (except for FIGS. 2 and 3, which aren't needed for blackjack) can be applied to a blackjack game as well. Also, "machine choice" in the above context of video poker can be substituted by the version of blackjack the player chooses to play (i.e. "Spanish 21," "Double Exposure," etc.) since each of these variations have different optimal returns. The variation of blackjack game played (like the variation of video poker played) can also be stored in the player's slot club account.

The methods/embodiments described herein can also be applied to other games of skill as well, such as Pai Gow Poker, 3 Card Poker™ game, Caribbean Stud Poker™ game, Triple Action™ (3-5-7 cards), Asian Poker™, 7 Card Stud, Ultimate Texas Hold' Em™, Mississippi Stud Poker™ and any game where there is a mathematical way of playing each hand.

In another embodiment of the present invention, the invention can also be applied to Internet casinos. Internet casinos are casinos which use a server to generate random numbers and transmit hand comprising values of cards (or dice, etc.) to a client computer, wherein a player can play casino games on the client computer for real money. The internet casino may wish to email special offers to players based on their parametric values or skill level. Such special offers can include bonus money which can automatically or manually be placed in the player's gaming account. A player's gaming account is an account which stores an amount representing real money which a player owns and uses to play with.

It is noted that generally, comp points may represent a "raw form" while dollar amounts are actual monetary amounts. In some cases, casinos may implement systems wherein one point=one dollar, and thus these terms may be used interchangeably. In other cases, a conversion between these two concepts (for some or all of types of comp points) may be needed an implemented by multiplying/dividing by a conversion factor or putting the subject for conversion into a formula.

It is also noted that any and/or all of the above embodiments, configurations, variations of the present invention described above can mixed and matched and used in any combination with one another. Any claim herein can be combined with any others (unless the results are nonsensical). Further, any mathematical formula given above also includes its mathematical equivalents, and also variations thereof such as multiplying any of the individual terms of a formula by a constant(s) or other variable.

This technology must be used in combination with processing technology that receives either by dealer input, player input or more preferably sensed and read input from the gaming apparatus itself.

Figure 1A:
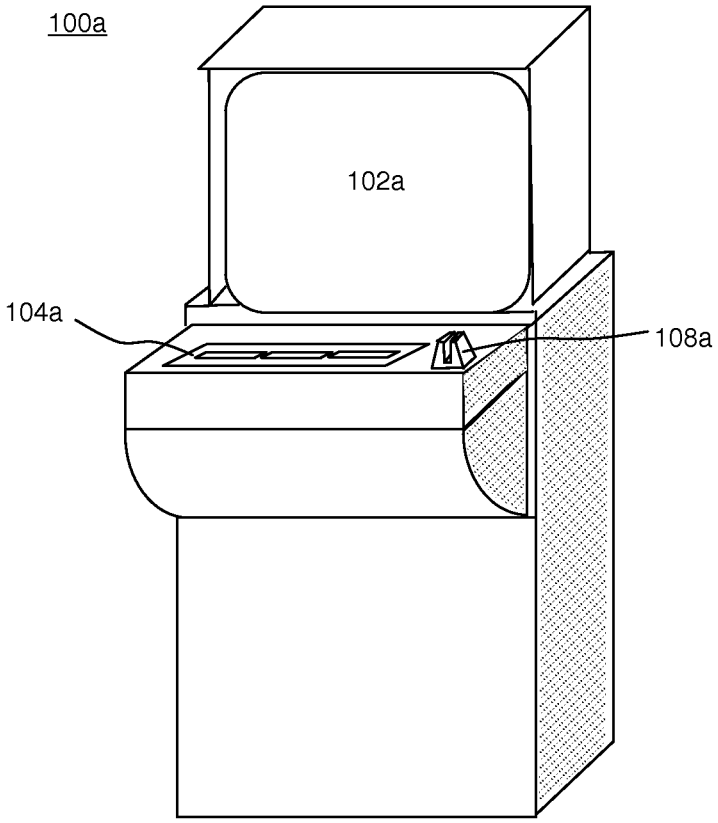
FIG. 1A is a diagram illustrative of an electronic gaming machine (EGM).

FIG. 1A is a diagram illustrative of an electronic gaming machine 100*a*, including a display screen 102*a*, player input buttons 104*a*, and credit or currency input 108*a*. When a player has entered sufficient credits from credit input 108*a*, the player can select a game using the player input via buttons 104*a* or touch screen buttons (not shown) displayed on the screen 102*a*, or a game can automatically be selected. The player can also select the pay lines and credits per line again using the player input.

Figure 2A:
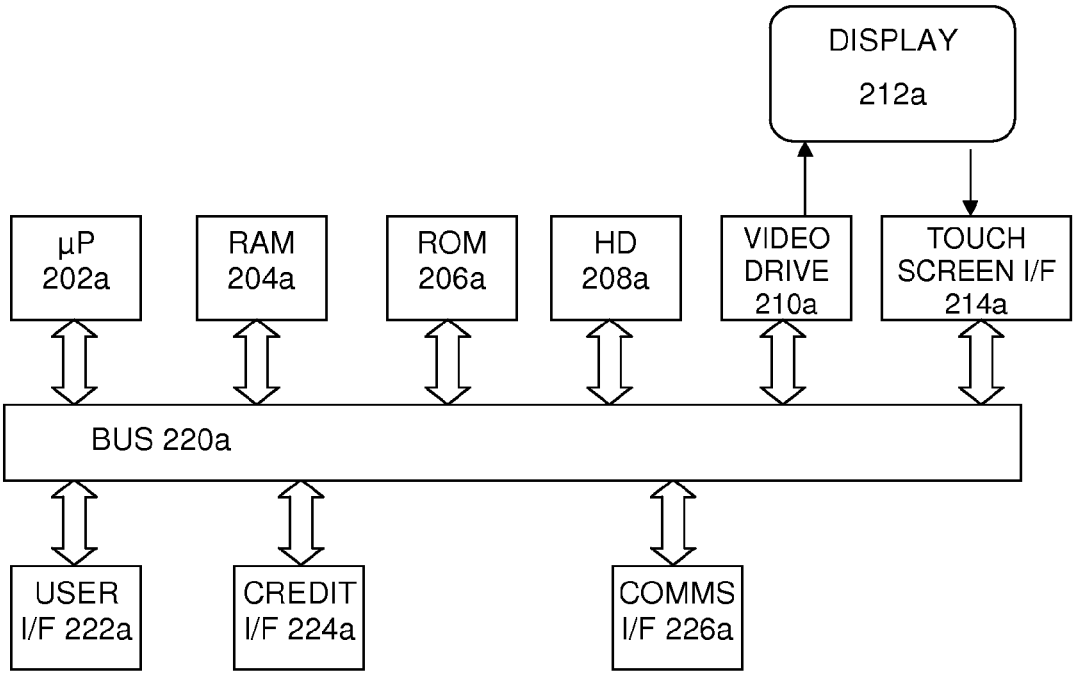
FIG. 2A is a block schematic diagram of functional elements of an EGM including a processor

FIG. 2A is a block schematic diagram of functional elements of an EGM including a processor 202*a* shown for illustrative purposes only as connected via bus 220*a* to a plurality of functional elements. The EGM can include a display 212*a* with associated video driver 210*a* and touch screen interface 214*a*, various storage devices such as RAM 204*a*, ROM 206*a* and hard drive 208*a*, a user interface 222*a*, credit interface 224*a*, and communication interface 226*a*. The EGM can be a stand-alone machine, or it can be connected to a network via the communication interface 226*a*, to enable the machine to participate in multi-game jackpots. In addition, the EGM may be programmed via the communication network from a central control and management processor, so that, for example, new games can be programmed and downloaded into the EGM.

There are numerous available computer languages that may be used to implement embodiments of the invention, among the more common being Ada; Algol; APL; awk; Basic; C; C++; Cobol; Delphi; Eiffel; Euphoria; Forth; Fortran; HTML; Icon; Java; Javascript; Lisp; Logo; Mathematica; MatLab; Miranda; Modula-2; Oberon; Pascal; Perl; PL/I; Prolog; Python; Rexx; SAS; Scheme; sed; Simula; Smalltalk; Snobol; SQL; Visual Basic; Visual C++; Linux and XML.

Any commercial processor may be used to implement the embodiments of the invention either as a single processor, serial or parallel set of processors in the system. Examples of commercial processors include, but are not limited to Merced™, Pentium™, Pentium II™, Xeon™, Celeron™, Pentium Pro™, Efficeon™, Athlon, AMD and the like.

Display screens may be segment display screen, analogue display screens, digital display screens, CRTs, LED screens, Plasma screens, liquid crystal diode screens, and the like.

Moreover, any description of a component or embodiment herein also includes hardware, software, and configurations which already exist in the prior art and may be necessary to the operation of such component(s) or embodiment(s).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

The invention claimed is:

1. A method of providing incentives to casino players based on play of the casino players at games in which quality of strategy of play can be determined comprising: a) identifying at least one specific player on a processor; b) capturing game play information of that at least one player on the processor; c) on hands where there are alternative strategies that can be played on specific hands, the processor identifying what strategy is executed by the at least one player; d) the processor determining a performance rate or valuation amount of the at least one player for the casino based upon specific strategy executed by the at least one player on the specific hands; e) collecting performance rates or valuation amounts over an at least statistically significant minimum number of played hands for the at least one player to determine at least one player valuator; and f) subsequent to the determination of the at least one player valuator, the processor providing the at least one player comps of value, the value of the comps determined by the processor based on the at least one player valuator for the at least one player.

2. The method of claim 1 wherein the at least one valuator is based on collective data from multiple specific individual hands of virtual playing cards in a poker game and the valuator is related to or equivalent to a statistical rate of return or a monetary amount for specific strategies on the specific individual hands of virtual playing cards as compared to predetermined optimal strategies for the specific hands of virtual playing cards.

3. The method of claim 1 wherein the value provided to the player is a multiplier of comp rates given by the casino during game play by the player and the statistically significant number of hands comprises at least 100 hands.

4. The method of claim 2 wherein the value provided to the player is a multiplier of comp rates given by the casino during game play by the player.

5. The method of claim 1 wherein the value provided to the player is a multiplier of comp rates given by the casino during game play by the player, and the processor causes a video display unit on a gaming machine to display to the at least one player a comp rate being provided to the at least one player that is higher than a comp rate contemporaneously publicized for all players at the casino.

6. The method of claim 2 wherein the value provided to the player is a multiplier of comp rates given by the casino during game play by the player, and the processor causes a video display unit on a gaming machine to display to the at least one player a comp rate being provided to the at least one player that is higher than a comp rate contemporaneously publicized for all players at the casino.

7. The method of claim 3 wherein the value provided to the player is a multiplier of comp rates given by the casino during game play by the player, and the processor causes a video display unit on a gaming machine to display to the at least one player a comp rate being provided to the at least one player that is higher than a comp rate contemporaneously publicized for all players at the casino.

8. The method of claim 4 wherein the value provided to the player is a multiplier of comp rates given by the casino during game play by the player, and the processor causes a video display unit on a gaming machine to display to the at least one player a comp rate being provided to the at least one player that is higher than a comp rate contemporaneously publicized for all players at the casino.

9. The method of claim 1 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor on wagers accepted by the processor for ranked hands at least selected from the group consisting of three-of-a-kind, straights, flushes, full houses, four-of-a-kind and straight flushes.

10. The method of claim 2 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor on wagers accepted by the processor for ranked hands at least selected from the group consisting of three-of-a-kind, straights, flushes, full houses, four-of-a-kind and straight flushes.

11. The method of claim 3 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor for ranked hands at least selected from the group consisting of three-of-a-kind, straights, flushes, full houses, four-of-a-kind and straight flushes.

12. The method of claim 4 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor for ranked hands at least selected from the group consisting of three-of-a-kind, straights, flushes, full houses, four-of-a-kind and straight flushes.

13. The method of claim 5 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor on wagers accepted by the processor for ranked hands at least selected from the group consisting of three-of-a-kind, straights, flushes, full houses, four-of-a-kind and straight flushes.

14. The method of claim 6 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor on wagers accepted by the processor for ranked hands at least selected from the group consisting of three-of-a-kind, straights, flushes, full houses, four-of-a-kind and straight flushes.

15. The method of claim 7 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor on wagers accepted by the processor for ranked hands at least selected from the group consisting of three-of-a-kind, straights, flushes, full houses, four-of-a-kind and straight flushes.

16. The method of claim 8 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor on wagers accepted by the processor for ranked hands at least selected from the group consisting of three-of-a-kind, straights, flushes, full houses, four-of-a-kind and straight flushes.

17. The method of claim 9 wherein the poker game comprises five card draw poker wherein the player is provided with an initial hand of five playing cards, and the processor enables discard and replacement of 0, 1, 2, 3, 4 or 5 cards to form a final five card poker hand that is evaluated for rank against a pay table, and awards are provided by the processor on wagers accepted by the processor for ranked hands at least selected from the group consisting of three-of-a-kind, straights, flushes, full houses, four-of-a-kind and straight flushes.

18. A video gaming apparatus comprising a display monitor, a processor and player input controls, the processor configured to display playing cards on the display monitor to enable play of the method of claim 1.

19. A video gaming apparatus comprising a display monitor, a processor and player input controls, the processor configured to display playing cards on the display monitor to enable play of the method of claim 5.

20. The method of claim 1 wherein the value is selected from the group consisting of comp rates, comp value, free spins, special bonus play, absolute value added to total comp value on a player card, discount at casino hotels, restaurants, shows, spas and other facilities, gifts, coupons for stores, cash, and credit.

21. The method of claim 1 wherein the value provided to the player is a multiplier of comp rates given by the casino during game play by the player, and a second processor causes a video display unit on a device separate from the gaming machine to display to the at least one player a comp rate being provided to the at least one player that is higher than a comp rate contemporaneous publicized for all players at the casino.

22. A method of providing incentives to casino players based on play of the casino players at games in which quality of strategy of play can be determined comprising: a) identifying at least one specific player on a processor; b) capturing game play information of that at least one player on the processor; c) on hands where there are alternative wagering strategies that can be played on specific hands, the processor identifying what wagering strategy is executed by the at least one player; d) the processor determining a percentage performance rate or valuation amounts for the casino based upon specific wagering strategy executed by the at least one player on the specific hands; e) collecting percentage performance rates or valuation amounts over an at least minimum number of played hands for the at least one player to determine at least one player valuator; and f) subsequent to the determination of the player valuator, providing the at least one player comps with value based on the at least one player valuator for the at least one player.

23. The method of claim 22 wherein the value is selected from the group consisting of comp rates, comp value, free spins, special bonus play, absolute value added to total comp value on a player card, discount at casino hotels, restaurants, shows, spas and other facilities, gifts, coupons for stores, cash, and credit.

24. A method of providing incentives to casino players based on play of the casino players at games in which quality of strategy of play or quality of strategy of wagering can be determined comprising: a) identifying at least one specific player on a processor having symbol display capability thereon; b) capturing game play information of that at least one player on player input to the processor; c) on rounds of play where there are alternative play and/or wager strategies that can be played on specific hands, the processor identifying what specific play and/or wager strategy is executed by the at least one player; d) the processor determining a valuation of performance rate or valuation amount for the casino based upon the specific wagering and/or play strategies executed by the at least one player on the specific hands; e) collecting valuation of performance rates or valuation amounts over an at least minimum number of played hands for the at least one player to determine at least one player valuator; and f) subsequent to the determination of the player valuator, providing the at least one player with value based on the at least one player valuator for the at least one player.

25. The method of claim 24 wherein the providing of the player with value is done inverse to determined player valuators for the at least one player.

26. The method of claim 24 wherein the providing of the player with value is done in direct proportion to determined player valuators for the at least one player.

27. The method of claim 24 wherein the value is selected from the group consisting of comp rates, comp value, free spins, special bonus play, absolute value added to total comp value on a player card, discount at casino hotels, restaurants, shows, spas and other facilities, gifts, coupons for stores, cash, and credit.

* * * * *